US006968660B1

(12) United States Patent
Novoa

(10) Patent No.: US 6,968,660 B1
(45) Date of Patent: Nov. 29, 2005

(54) SHUTTER ASSEMBLY

(76) Inventor: Pablo Raba Novoa, 6050 SW. 88 Ct., Miami, FL (US) 33173

( * ) Notice: Subject to any disclaimer, the term of this patent is extended or adjusted under 35 U.S.C. 154(b) by 61 days.

(21) Appl. No.: 10/298,897

(22) Filed: Nov. 18, 2002

(51) Int. Cl.[7] ..... E06B 007/08
(52) U.S. Cl. ..... 52/473; 49/74.1
(58) Field of Search ..... 52/473, 202, 656.7, 52/483.1; 160/166.1; 49/74.1

(56) References Cited

U.S. PATENT DOCUMENTS

| | | | | |
|---|---|---|---|---|
| 1,308,254 | A | 7/1919 | Otto | |
| 2,388,927 | A | 11/1945 | Moor, Jr. | |
| 3,022,549 | A * | 2/1962 | Cummings | 49/64 |
| 3,286,242 | A | 11/1966 | Weyant | |
| 3,604,146 | A | 9/1971 | Winer | |
| 3,621,626 | A | 11/1971 | Tylius | |
| 3,893,273 | A | 7/1975 | Sailor | |
| 4,160,343 | A * | 7/1979 | Hubbard | 49/90.1 |
| 4,384,436 | A | 5/1983 | Green | |
| 4,485,589 | A * | 12/1984 | Rodriguez-Torres | 49/38 |
| 4,655,003 | A | 4/1987 | Henley, Sr. | |
| 4,736,566 | A | 4/1988 | Krotsch | |
| 4,947,595 | A | 8/1990 | Douds et al. | |
| 4,967,509 | A * | 11/1990 | Storey et al. | 49/74.1 |
| 5,181,548 | A * | 1/1993 | Matthews | 160/172 R |
| 5,339,591 | A | 8/1994 | Underdahl | |
| 5,347,775 | A | 9/1994 | Santos | |
| 5,383,315 | A | 1/1995 | Birs | |
| 5,392,561 | A | 2/1995 | Henley, Sr. | |
| 5,469,905 | A | 11/1995 | McKinney et al. | |
| 5,472,037 | A | 12/1995 | Hoffman | |
| 5,493,836 | A | 2/1996 | Lopez-Munoz | |
| 5,540,018 | A | 7/1996 | Biggers | |
| 5,595,233 | A | 1/1997 | Gower | |
| 5,596,849 | A | 1/1997 | Hill | |
| D388,278 | S * | 12/1997 | Howitt | D7/388 |
| 5,848,505 | A | 12/1998 | Taylor | |
| 5,911,660 | A | 6/1999 | Watson | |
| 5,957,186 | A | 9/1999 | Boswell | |
| 5,996,292 | A | 12/1999 | Hill et al. | |
| 6,000,666 | A * | 12/1999 | Kari | 248/150 |
| 6,014,842 | A | 1/2000 | Matsubara | |
| 6,209,263 | B1 | 4/2001 | Poirier | |
| 6,550,198 | B1 | 4/2003 | Endo et al. | |
| 6,568,144 | B2 | 5/2003 | Meredith | |
| 6,604,322 | B2 * | 8/2003 | Horn et al. | 49/64 |
| 6,675,534 | B2 * | 1/2004 | Marocco | 49/86.1 |

* cited by examiner

*Primary Examiner*—Anita M. King
(74) *Attorney, Agent, or Firm*—Malloy & Malloy, P.A.

(57) ABSTRACT

A shutter assembly comprising a frame assembly including spaced apart peripheral base segments connected to a plurality of mounting members, wherein the base segments are secured to a supporting structure. A plurality of slats, each including a passageway for receiving the plurality of mounting members are secured to the mounting members in any one of a plurality of predetermined arrays, which extend along a length of the frame assembly in at least partially overlying, protective relation to a window, door or other portion of the supporting structure. A locking assembly may be used to secure the plurality of slats to the mounting members and may be disposed and structured to facilitate the attachment of the frame assembly to the supporting structure.

36 Claims, 5 Drawing Sheets

SHUTTER ASSEMBLY

BACKGROUND OF THE INVENTION

1. Field of the Invention

This invention relates to a shutter assembly which may be fixedly or removably attached to a building or other support structure in protective relation to a portion thereof and which includes a plurality of slats removably interconnected into any one of a plurality of predetermined arrays so as to provide a completely closed or at least partially open configuration of the shutter assembly.

2. Description of the Related Art

In the protection of both domestic and commercial buildings, the use of shutters, exteriorly mounted in a protective position relative to doors, windows or other portals, is extremely well known throughout the world. Naturally, shutter protection in geographical areas subject to extreme weather conditions, such as hurricanes and the like, is even more common. As such, conventionally structured shutters may be permanently and movably attached, frequently in some type of decorative arrangement, to the exterior of the building. Regardless of the geographical area in which shutters are used, they may also be removably attached in an intended protective position relative to various portions of a building or other structure. In the simplest form, shutters are created on an "emergency" basis by merely nailing or otherwise securing sheets of rigid material, such as plywood or the like, in overlying relation to windows, doors, etc.

Because of the popularity and extensive use of shutters the individual structural features thereof may vary greatly. Also, while known shutter structures are commonly used to protect a building against damage from storms, many shutter structures are also designed to provide a measure of security in preventing or resisting unauthorized entry through a window or door, whether or not the building is occupied. In this latter category of conventional shutter structures, many designs are intended to be permanently secured to the exterior of a dwelling in a manner which allows viewing therethrough by individuals from the interior of a dwelling or other building.

Because of the extensive use of shutter assemblies many conventional structures are designed to provide adequate protection and security while at the same time enhancing the overall aesthetic appearance of the exterior of a building on which they are used. In these more sophisticated shutters, some type of support frame is secured about and at least partially defines the periphery of the shutter. In addition a plurality of slats or louvers are either fixedly or movably mounted to the frame, wherein in the latter category the spacing between the individual louvers or slats may be adjusted to facilitate viewing, air circulation, etc. Whether a shutter structure is of the type incorporating fixed or movable louvers, a primary area of concern is the structural features which serve to mount or secure the plurality of louvers to a supporting frame in a manner which accomplishes the intended fixed or movable orientation of the louvers in an effective, reliable and efficient manner. A problem that is common to known shutter structures incorporating fixed or movable slats or louvers is the difficulty and the expense of removing, and repairing or replacing an individual slat or louver that has been damaged.

Another category of more sophisticated high impact, storm resistant shutters comprises a plurality of slats interconnected to one another along corresponding, longitudinal edges thereof. The slats are arranged in a somewhat "layered" configuration or, alternatively, are movably secured to one another about the aforementioned longitudinal edges in somewhat of an accordion type of configuration. This latter shutter structure allows the individual slats to be collapsed or folded upon themselves such that the entire shutter assembly may be easily disposed in either a stored position or extended along a supporting frame into an expanded, operative position in overlying, protecting relation to a door, window, etc. Shutters of this type present an even greater problem, as should be apparent, when a slat or slats are damaged, and must be replaced.

As set forth above, known protective shutter structures may assume a variety of different structural configurations. However, in recent years extreme weather, including hurricanes has caused massive damage to certain areas of the United States. As a result, many states mandate significantly stringent code requirements for shutters in order to provide adequate protection to both homes and businesses. By way of example, a building code presently enforced in South Florida is considered one of the nations most stringent and requires that shutters withstand specific impact forces in order to comply with the code requirements. As a result, many previously installed shutters presently being utilized in the state of Florida and in other locations may not have sufficient structural integrity to meet local code requirements.

Therefore, there is a recognized need in the shutter industry for an improved or preferred shutter assembly which overcomes the well known disadvantages and problems recognized in the industry. For example, it would be beneficial to provide a shutter assembly having individual shutter slats which are easy to install, remove, and/or replace. Additionally, a shutter assembly having the versatility of being fixedly or removably attached to the building or other structure with which it is associated, would be helpful. Also, such an improved shutter assembly should have the structural versatility of including a plurality of slats which are removably secured to a frame or other mounting assembly in a manner which easily allows the user to vary the configuration or array of the slats. Of course, any such improved shutter assembly must meet all local and/or state code requirements in terms of impact resistant capabilities.

By way of example, a preferred shutter assembly should be capable of providing a "closed" configuration wherein a window, door, etc. is completely covered. Alternatively, such a preferred shutter assembly should allow fixed or adjustable spacing between the individual slats so as to provide meaningful security against unauthorized entry during periods when maximum protection against storms and bad weather is not a primary concern. Further, when such an improved or preferred shutter assembly is installed either permanently or temporarily, the overall appearance thereof should not detract from the exterior appearance of the building on which it is mounted. Finally, the material from which a preferred shutter assembly is formed should be substantially rigid and high strength but sufficiently light weight to facilitate its installation and/or removal by one or a few untrained individuals in a relatively short period of time.

SUMMARY OF THE INVENTION

The present invention is directed to a shutter assembly of the type capable of being attached to a supporting structure such as a dwelling, industrial building or a variety of other structures. When mounted in its operative position, the shutter assembly of the present invention provides protection against property damage due to storms, hurricanes or other extreme whether conditions. In addition, the subject shutter assembly is capable of assuming any one of a plurality of predetermined structural configurations, wherein a plurality of slats associated with the shutter assembly are oriented in different arrays dependent, at least in part, on the intended function of the shutter assembly at a particular time.

By way of example, one predetermined array of the plurality of slats may be a "closed" configuration. As such the plurality of slats are disposed in confronting engagement with one another so as to completely cover an area, such as a window or the like, of the building or other structure being protected. Alternatively, the slats may be oriented in spaced relation to one another to provide a more "open" configuration which allows viewing by occupants within the building therethrough, while providing meaningful protection particularly against unauthorized entry of the window, door, or other portion of the building or other structure with which the shutter assembly is associated.

More specifically, the shutter assembly of the present invention comprises at least one but preferably a plurality of peripheral base segments disposed in spaced apart relation to one another and located at opposite ends of a supporting frame assembly. The frame assembly further comprises a mounting assembly including a plurality of spaced apart mounting members preferably formed of rigid, high strength material rods or like elongated members. The mounting members have their opposite ends connected to correspondingly positioned ones of the base segments in a manner which will be described in greater detail hereinafter. The mounting members or rods are preferably disposed in transverse relation to the connected base segments and in parallel relation to one another. The number of mounting members may vary from at least one to a plurality, dependent on the overall size and configuration of a given shutter assembly, which may of course vary dependent on a particular and intended application thereof.

The aforementioned plurality of slats are mounted on the supporting frame in any one of a plurality of predetermined arrays. As such, the plurality of slats are collectively disposed to extend along a length of the frame assembly between the base segments or along the entire distance between the base segments, dependent on the preferred configuration or predetermined array which the plurality of slats assume. It is emphasized that the term "slat" is used herein in its broadest descriptive sense and is specifically not limited to an elongated, flat, louver like structure. To the contrary, as used herein, in one embodiment the slats may comprise a hollow interior portion extending along at least a portion of the length of the individual slats and preferably along substantially the entire length thereof, while in another embodiment the slats may comprise a substantially solid configuration. Further each of the plurality of slats has closed or capped ends as well as at least partially closed longitudinal sidewalls or edges. In addition, each of the slats are formed from a substantially rigid, high strength material, preferably lightweight, material such as, but not limited to, aluminum, aluminum alloy, steel or other metals. A variety of other materials may also be used to form the slats, including, by way of example only, wood and/or high strength plastic, wherein such material demonstrates sufficient structural integrity, including strength, rigidity, etc. to resist high impact forces during the aforementioned types of extreme weather conditions.

Another feature associated with each of the plurality of slats is the provision of a passageway formed therein. More specifically, the passageway of each slat comprises at least one or preferably a plurality of passages extending transversely therethrough. The passages are dimensioned, disposed and sufficient in number, such that each accommodates the passage therethrough of one of the plurality of mounting members to which the plurality of slats are connected. Accordingly, individual ones of the passages in the plurality of slats are disposed in a predetermined linear alignment with one another such that a corresponding passage in each slat receives a common one of the plurality of mounting members. It should be apparent that based on the disposition of the plurality of mounting members relative to the plurality of slats and the fact that the mounting members are formed from a substantially rigid, high strength material, the mounting members serve not only as an efficient means of interconnecting and supporting the plurality of slats, but also as a reinforcement structure which enhances the ability of the shutter assembly to resist high impact forces.

Another feature of at least one preferred embodiment of the shutter assembly of the present invention is the provision of a locking assembly which secures the plurality of slats to one another and/or to the plurality of mounting members passing through the plurality of slats. When utilized, the locking assembly of the present invention includes at least one but preferably a plurality of locking members which may be equal in number to the number of mounting members. Moreover, the locking members are secured or otherwise structured to receive corresponding ends of the mounting members. In addition, each of the one or more locking members includes through channels oriented transversely to the disposition of the mounting members to which they are secured. Connecting members, such as bolts or like anchoring structures, pass into the through channels and are embedded, anchored or otherwise affixed to the surface or other portion of the supporting structure on which the shutter assembly of the present invention is mounted.

Accordingly, the shutter assembly of the present invention, in each of its preferred embodiments, may be quickly and efficiently secured in its operative, protective position on the exterior or other portion of a building or other structure. When so positioned, the plurality of slats protectively overly or cover a window, door or other area of the building intended to be protected. Further the plurality of slats are removably connected to the plurality of mounting members, such that they may be alternatively arranged in a variety of different predetermined arrays depending upon the intended purpose and function of the shutter assembly of the present invention.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in the accompanying Figures, the present invention is directed to a shutter assembly generally indicated as 10. The shutter assembly 10 is structured to be removably or fixedly secured to the exterior of a domestic, commercial or other type of building structure. As such, the building to which the shutter assembly 10 is attached will serve as a supporting structure, as set forth in greater detail hereinafter. The specific supporting structures referred to herein may of course vary and for purposes of clarity are not shown in the accompanying Figures. Further, the shutter assembly 10 is designed to substantially overly and fully or at least partially cover windows, doors, or other portals as well as other portions of a building or other structure which require protection. In its various operable configurations, the shutter assembly 10 may be used to provide protection from storms, hurricanes or other extreme weather conditions as well as prevent unauthorized entry through a window, door, etc.

Therefore, the shutter assembly 10 comprises a frame assembly generally indicated as 12 which is integrated into the complete protective structural features of the shutter assembly 10 by the inclusion of at least one, but preferably a plurality of base segments, as at 14 and 16, substantially oppositely disposed from one another. Each of the base segments 14 and 16 define a peripheral portion of the frame assembly 12 and, also as more fully described hereinafter, each of the base segments 14 and 16 resemble one of the plurality of slats 18, both in structure and appearance. As should be apparent, the dimension and configuration of the shutter assembly 10 and, accordingly, the frame assembly 12 may vary, at least partially dependent on the portion of the building or other structure with which it is associated and intended to protect. As such, the number and/or dimensions of the plurality of slats 18 may vary. Additionally, the slats 18 shown throughout the figures comprise a generally flat, rectangular surface configuration, however, this is solely for the purpose of ease of illustration, as it is understood to be within the scope of the present invention for the slats 18 to comprise a variety of surface configurations including, by way of example only, rounded, conical, triangular, concave, convex, etc., such as may be preferable for aesthetic as well as structural considerations.

Figure 3:
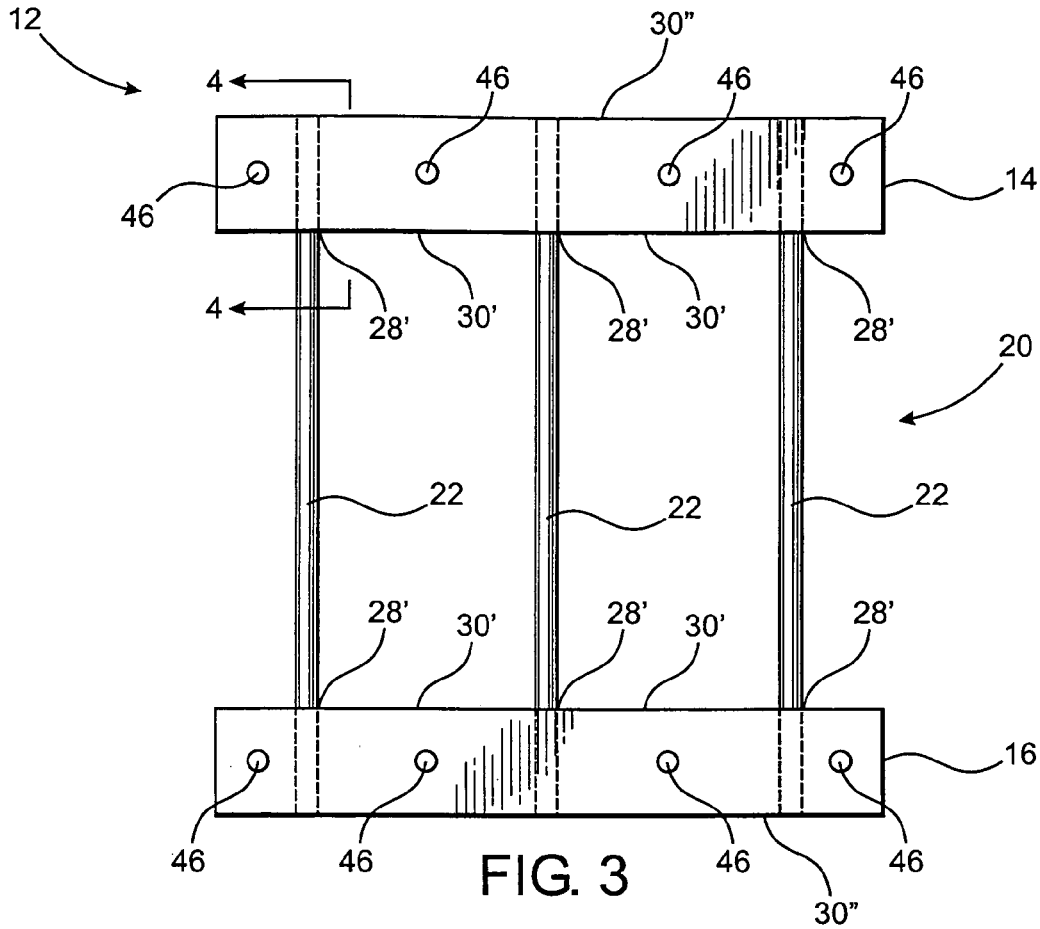
FIG. 3 is a front plan view of a frame assembly portion of the embodiments of FIGS. 1 and 2.

The frame assembly 12 further comprises a mounting assembly generally indicated as 20. The mounting assembly 20 includes at least one but preferably a plurality of mounting members 22 disposed in spaced, preferably parallel relation to one another as best shown in FIG. 3. Further, each of the mounting members 22 have their opposite ends as at 22' connected to corresponding ones of the base segments 14 and 16. Depending on which of the preferred embodiments of the shutter assembly 10 are being utilized, one or both of the opposite ends 22' of the plurality of mounting members 22 may be threaded or otherwise structured to facilitate connection to the corresponding base segments 14 and 16, as will be described with specific reference to FIGS. 11 and 12.

The mounting assembly 20 and particularly the one or more mounting members 22 serve to connect and at least partially support the plurality of slats 18 in their intended operative position on the frame assembly 12. As such, each of the plurality of mounting members 22 have a sufficiently elongated configuration to extend between the base segments 14 and 16 so as to at least partially define the corresponding length or dimension of the shutter assembly 10. Further, the one or more mounting members 22 are oriented in at least transverse relation to each of the base segments 14 and 16, and are preferably oriented essentially perpendicular thereto, as clearly shown in FIG. 3.

It is also emphasized that the number and specific positioning of the one or more mounting members 22 may vary dependent on the dimension and configuration of the completed shutter assembly 10. Also, to provide maximum protection against high impact forces, such as those potentially occurring during a storm, each of the mounting members 22, as well as the base segments 14 and 16 and the plurality of slats 18 are formed from a substantially rigid, high strength material such as aluminum, aluminum alloy, steel or other metals. It is of course contemplated that other materials having sufficient structural integrity may be utilized including, but not limited to, wood, high strength plastics, etc. As set forth above, the mounting members 22 serve to connect and at least partially support the plurality of slats 18, in at least one of a plurality of predetermined arrays, as the plurality of slats 18 collectively extend between the base segments 14 and 16. As illustrated throughout the figures, vertically oriented arrays of the plurality of slats 18 are depicted, however, it is well within the scope and understanding of the present invention to encompass horizontally oriented arrays of the plurality of slats 18 as well.

Figure 5:
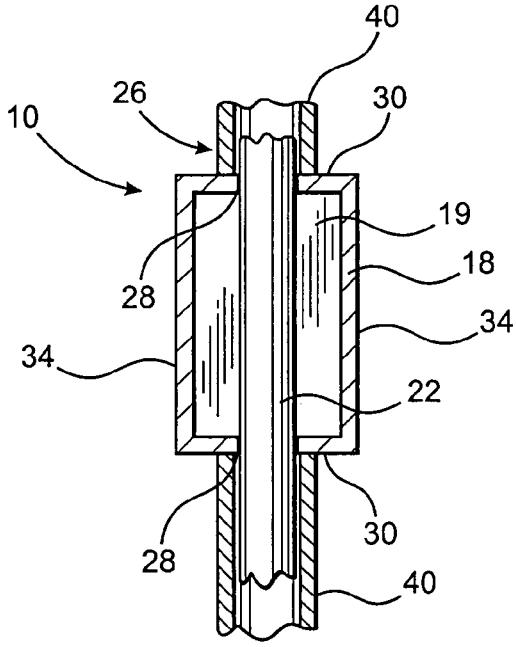
FIG. 5 is a sectional view in partial cutaway along line 5—5 of FIG. 2.
Figure 7:
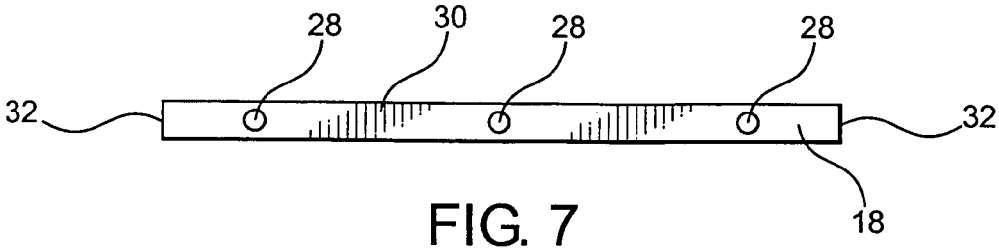
FIG. 7 is a top view of the embodiment of FIG. 6.
Figure 6:
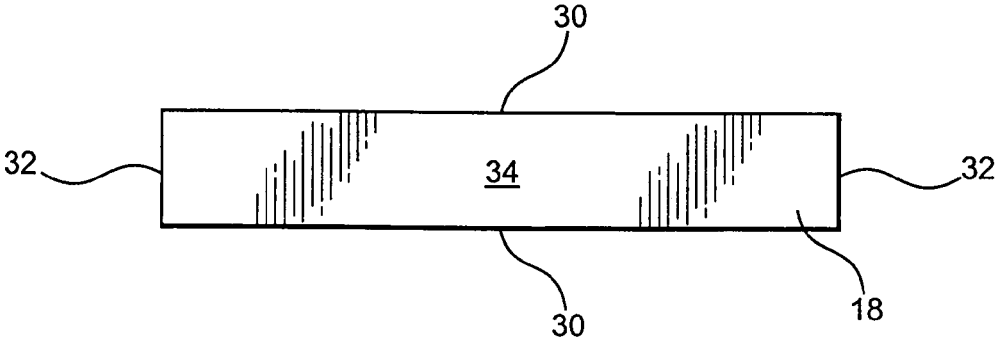
FIG. 6 is a front plan view of one of a plurality of slats associated with a preferred embodiment of the shutter assembly of the present invention.
Figure 8:
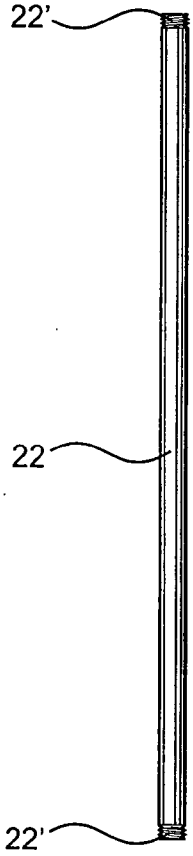
FIG. 8 is a front plan view of one of a plurality of mounting members associated with at least one preferred embodiment of the shutter assembly of the present invention.
Figure 9:
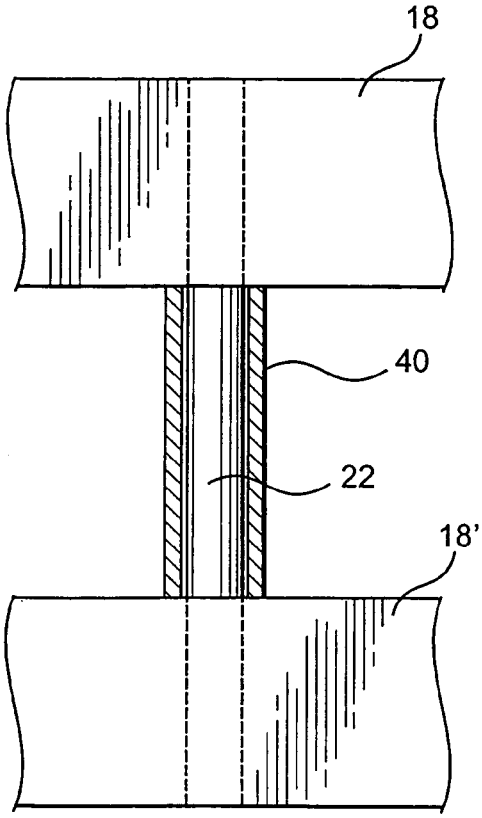
FIG. 9 is a sectional view in partial cutaway of one of a plurality of spacer members associated with a spacer assembly of a preferred embodiment of the shutter assembly of the present invention.

With primary reference to FIGS. 5 through 7, each of the plurality of slats 18 preferably includes a substantially hollow interior configuration as at 19 extending along at least a portion of the length thereof, to reduce the weight of each of the plurality of slats 18. However, it is understood that, alternatively, the plurality of slats 18 may comprise a substantially solid configuration. Attachment of the slats 18 to the frame assembly 12 is facilitated through the provision of a passageway generally indicated as 26 formed in each of the slats 18. The passageway 26 preferably comprises a plurality of passages 28 formed in oppositely disposed longitudinal sides or edges 30 of each of the slats 18. As such, the passages 28 are disposed and dimensioned to receive and allow passage therethrough of corresponding ones of the mounting members 22. In at least one preferred embodiment, the passages 28 have a substantially round or circular configuration so as to correspond to a preferred sectional configuration of the mounting members 22 which may comprise an elongated rod. Other shapes and structures of both the mounting members 22 and the passages 28 are of course to be included within the intended spirit and scope of the present invention, including, but not limited to elliptical, polygonal, etc. Other structural features associated with a preferred embodiment of the slats 18 include closed end portions 32, as shown in FIGS. 6 and 7, and exposed, oppositely disposed outer faces 34, as in FIG. 6, or 34' and 34", as further illustrated in FIG. 12.

Figure 4:
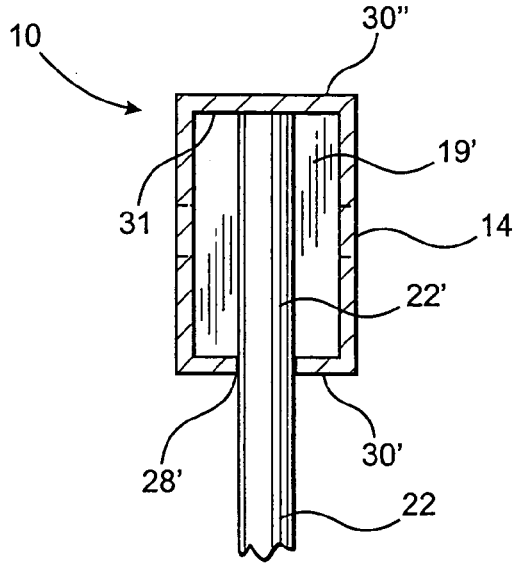
FIG. 4 is a sectional view in partial cutaway along line 4—4 of FIG. 3.
Figure 11:
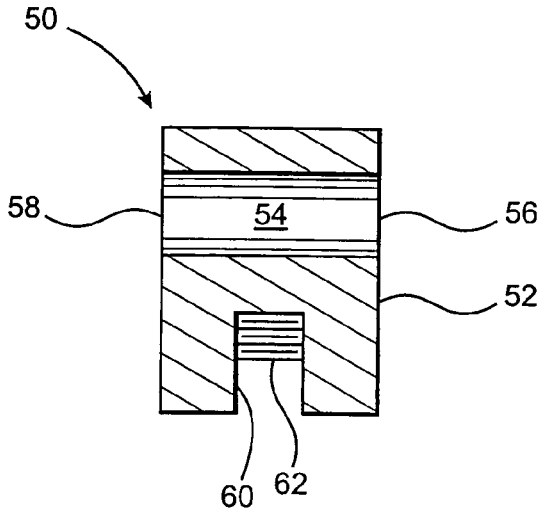
FIG. 11 is a sectional view of one of a plurality of locking members associated with a locking assembly of at least one preferred embodiment of the shutter assembly of the present invention.
Figure 12:
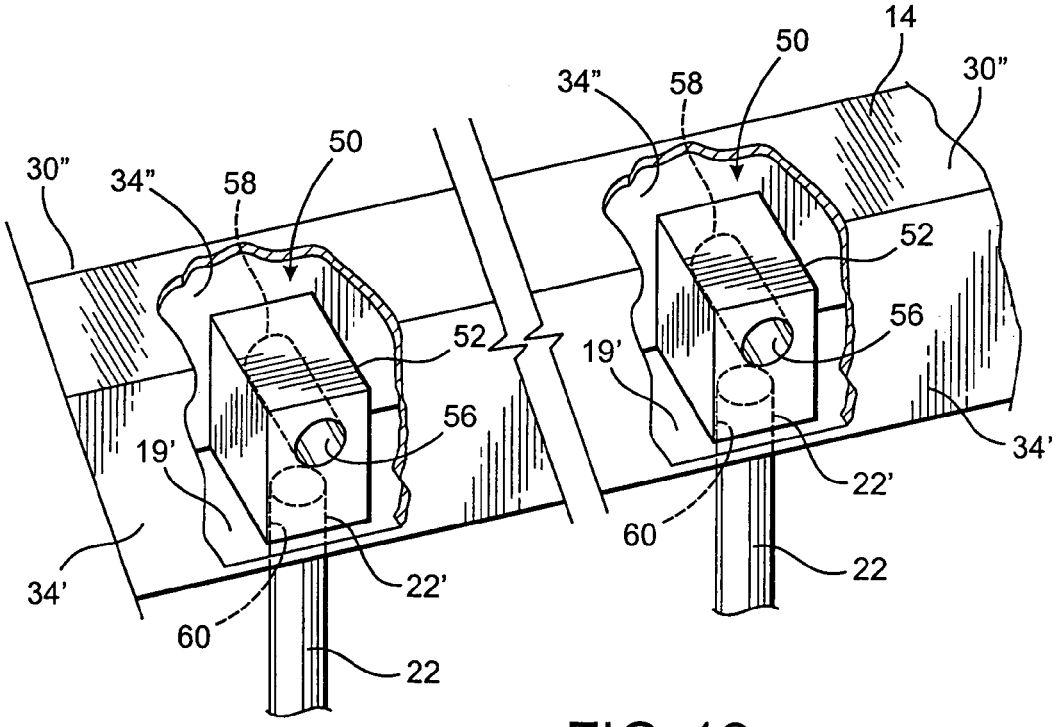
FIG. 12 is a perspective view in partial cutaway disclosing a plurality of locking members of the embodiment of FIG. 11 shown in an at least partially assembled position.

The base segments 14 and 16 are structured similarly to the plurality of slats 18 in order to receive the one or more mounting members 22 therein. More specifically, each of the innermost longitudinal sides or edges 30' may include openings or inlets as at 28' to facilitate the passage of the ends 22' therethrough into the interior 19' of the base segments 14 and 16. The structural features which facilitate securement of the opposite ends 22' of the mounting members 22 to the base segments 14 and 16 may vary between the preferred embodiment of FIGS. 2, 3, and 4 and an additional preferred embodiment as best shown in FIGS. 1, 11, and 12.

Figure 1:
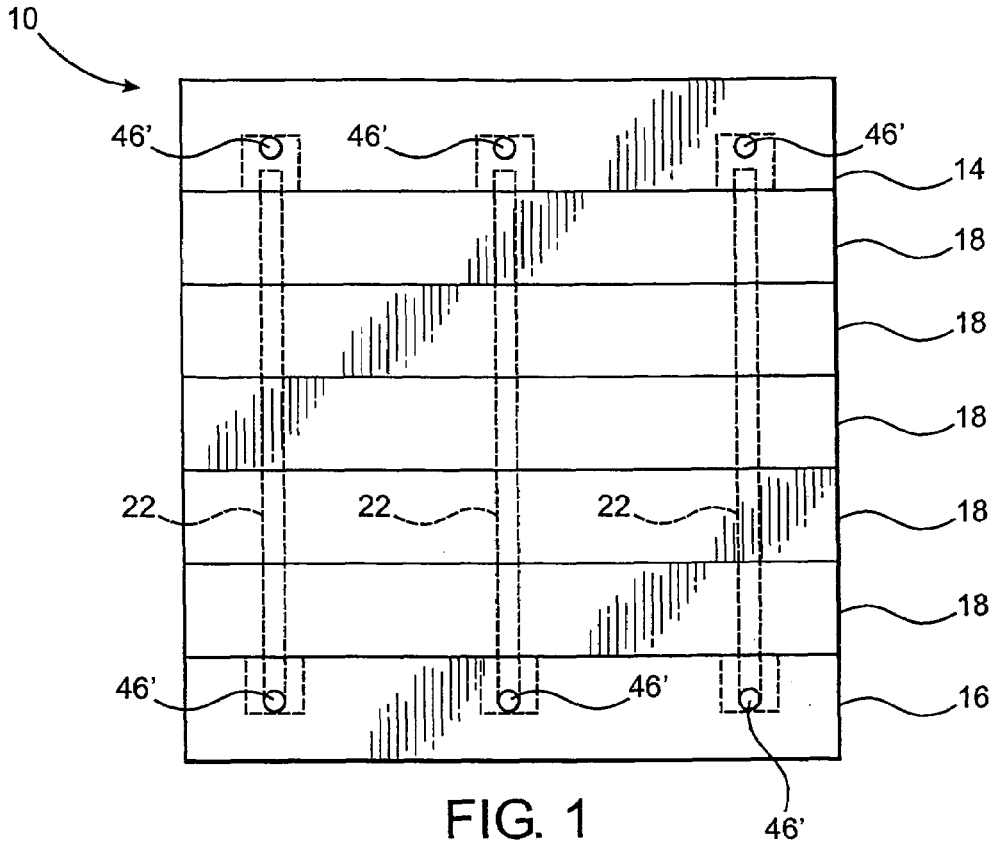
FIG. 1 is a front plan view of a shutter assembly of the present invention wherein a plurality of slats thereof are disposed in closed configurational array.
Figure 2:
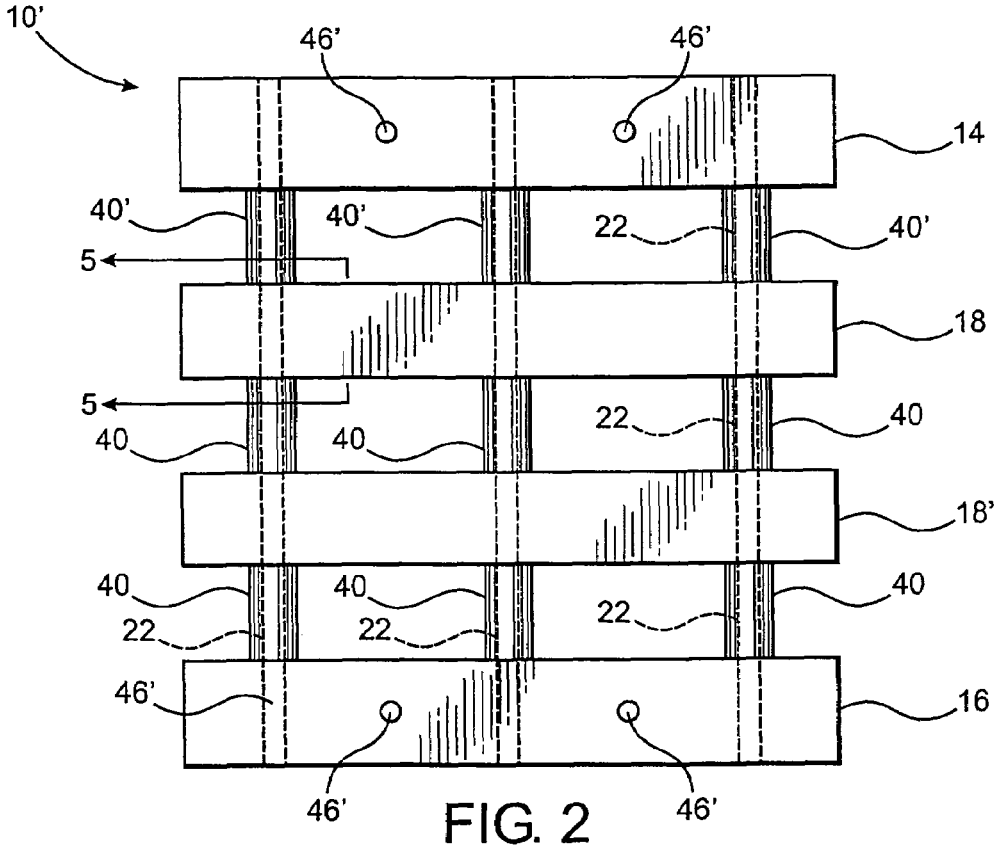
FIG. 2 is a front plan view of the shutter assembly of the present invention wherein the plurality of slats are interconnected in an at least partially open configurational array.

As should be apparent, the passages 28 of the passageway 26 of each of the slats 18 are aligned with one another so as to facilitate the passage therethrough of the one or more mounting members 22, as best shown in FIGS. 1, 2, and 5. Also, the cooperative structuring of the passageways 26 of the plurality of slats 18 and the provision of the one or more mounting members 22 facilitate the removable mounting or securement of the individual slats 18 on the frame assembly 12. Therefore, the slats 18 may be arranged in any one of a plurality of different arrays so as to assume a "closed" configuration, depicted in FIG. 1, or an at least partially "open" configuration, as depicted in FIG. 2. It should also be apparent that the closed configuration of FIG. 1 comprises each of the slats 18 disposed in confronting relation to adjacent ones of the slats 18. Also, the end most slats 18 confrontingly engage the corresponding base segment 14 and 16. This closed configuration defines one of a plurality of predetermined arrays and is intended to provide maximum protection to a portion of the building or other structure on which the shutter assembly 10 is mounted. In at least one embodiment, the plurality of slats 18 are structured and disposed to engage and at least partially interlock with adjacent slats 18, as well as with each of the base segments 14 and 16, thereby providing additional structural integrity to the shutter assembly 10 when the plurality of slats 18 are arranged in a "closed" and interlocked configuration.

However, in the embodiment of FIG. 2, the shutter assembly 10' includes the plurality of slats 18 being removably disposed in a different predetermined one of a plurality of possible arrays including the aforementioned open configuration. In such an "open" configuration, at least some of the plurality of slats, such as substantially adjacent slats 18 and 18', may be disposed in spaced relation to one another. Similarly, the slats 18 and 18' may be disposed in spaced relation to the corresponding base segments 14 and 16. This "open" configuration may provide somewhat less protection against high impact forces prevalent during storm condition, particularly by objects making impact between the slats 18 and 18'. However, such an "open" configuration does allow viewing of the exterior by individuals within the building or other structure being protected, yet prevents access from the exterior other than through the limited opening between slats 18 and 18'.

It should be further noted that the aforementioned "open" configuration may be defined by others of a plurality of possible arrays, such that a greater number of the slats 18 may also be disposed in spaced relation to one another. Alternatively, adjacent ones of the slats and/or base segments, such as at 18' and 16 respectively, may be disposed in confronting relation to one another. Again, the specific number of slats 18 utilized may of course vary dependent on the overall size and configuration of the shutter assembly 10 and/or 10'.

Figure 10:
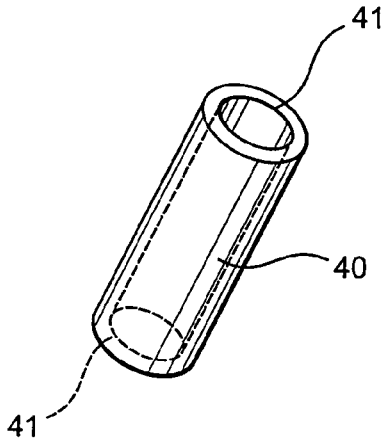
FIG. 10 is a detail view in perspective of one spacer member of the embodiment of FIG. 9.

Another structural feature of the shutter assembly 10, 10' of the present invention is the provision of a spacing assembly. The spacing assembly preferably comprises a plurality of spacer members 40, as shown in detail in FIG. 10. The spacer members 40 preferably include an elongated configuration corresponding to an intended distance or "spacing" between the adjacent slats 18 and 18' and/or between a slat 18 and a base segment 14, as depicted in FIG. 2. Further, each of the spacer members 40 includes a hollow interior communicating with oppositely disposed open ends 41. This structural configuration facilitates the passage therethrough of a corresponding mounting member 22. As such, the opposite open ends 41 confront the longitudinal sides or edges 30 and 30' of adjacently positioned but spaced apart mounting members 18 and/or base segments 14 and 16. Naturally, the longitudinal dimension of each of the spacer elements 40 which are disposed between the same adjacently disposed but spaced apart slats as at 18 and 18' should be equal. However, it should also be apparent that the spacing between different slats 18 or between the one of the slats 18 and either base segment 14 and 16 may vary based on the longitudinal dimensions of the spacer members 40 and 40' being different.

In at least one preferred embodiment as shown in FIGS. 2 and 3, the shutter assemblies 10 and/or 10' are attached to the exterior or other portions of the building or other structure by means of one or more openings 46 formed in and passing completely through the base segments 14 and 16. These openings 46 are dimensioned, disposed and configured to receive some type of connecting anchor such as an elongated anchor bolts. Each of the one or more anchor bolts or like connectors (not shown for purposes of clarity) has their distal or outer most end embedded or otherwise secured to the building or other structure on which the shutter assembly 10 and/or 10' is mounted.

Therefore, in the preferred embodiment of the shutter assembly 10 as shown in FIGS. 2 and 3, each of the opposite ends 22' of the one or more mounting members 22 pass through the inlet openings 28' and engage an interior surface 31 of the outermost longitudinal sidewall 30" of each of the base segments 14 and 16. Due to the fact that both of the base segments 14 and 16 are securely anchored or otherwise mounted on the building or other structure through the provision of the aforementioning anchoring bolts or like connectors, the opposite ends of 22' of each of the mounting members 22 are securely "trapped" within the interior 19' of the respective base segments 14 and 16.

However, the shutter assembly of the present invention includes yet another preferred embodiment primarily directed to securing the mounting members 22 to the respective base segments 14 and 16. This additional preferred embodiment is also directed to the mounting or attachment of the shutter assembly 10 or 10' to the building or other structure with which it is associated. With primary reference to FIGS. 1, 11 and 12, this preferred embodiment comprises a locking assembly generally indicated as 50. The locking assembly 50 includes at least one but more practically a plurality of locking members 52. Each of the locking members 52 may be fixedly secured or removably mounted within the interior 19' of each of the base segments 14 and 16.

Further, each of the locking members 52 includes a through channel 54 communicating with opposite open ends 56 and 58. An open ended receiving channel 60 is disposed in communicating relation with one end of each of the locking members 52. The fixed or removable orientation of the locking members 52 on the interior 19' of each of the base segments 14 and 16 is such that the opening 56 of the through channel 54 is aligned with one of the connector openings 46' formed in the respective base segments 14 and 16, as best shown in FIG. 1. Therefore, the securement or anchoring of the base segments 14 and 16 occurs by one of the aforementioned anchoring bolts or like connectors passing completely through channels 54 of each of the one or more locking members 52 so as to be embedded in the building or other structure to which the shutter assembly 10 or 10' is attached.

Also, a correspondingly positioned one of the opposite ends 22' of a mounting member 22 passes into the interior of an open ended receiving channel 60. As shown, the receiving channel 60 may have an internally threaded surface as at 62 for threaded engagement with a corresponding one of the opposite ends 22'. As illustrated throughout the figures, the locking members 52 are shown to comprise a substantially rectangular external configuration, however, it is within the scope of the present invention to provide locking members 52 comprising any one of a number of external configurations, including but not limited to square, spherical, cylindrical, triangular, or other geometric configurations as required to facilitate manufacturing, constructability, and/or installation of the shutter assembly 10 of the present invention.

In at least one embodiment, the locking members 52 of the locking assembly 50 may be mounted directly to the building or other structure to which the shutter assembly 10 is to be attached by passing the aforementioned anchoring bolts or like connectors directly through the channels 54 of each of the locking members 52 and directly embedding the connectors into the building or other structure, thereby eliminating the base segments 14 and 16 altogether. In this embodiment, oppositely disposed corresponding ones of the locking members 52 are securely threaded onto the opposite ends 22' of each of the support members 22 which extend outward through the passages 28 of the outermost slats 18 of the assembly 10, the locking members 52 serving to maintain the plurality of slats 18 in position adjacent one another and/or to spacer members 40 or 40', and in a protective relation relative to the building or other structure.

Figure 11A:
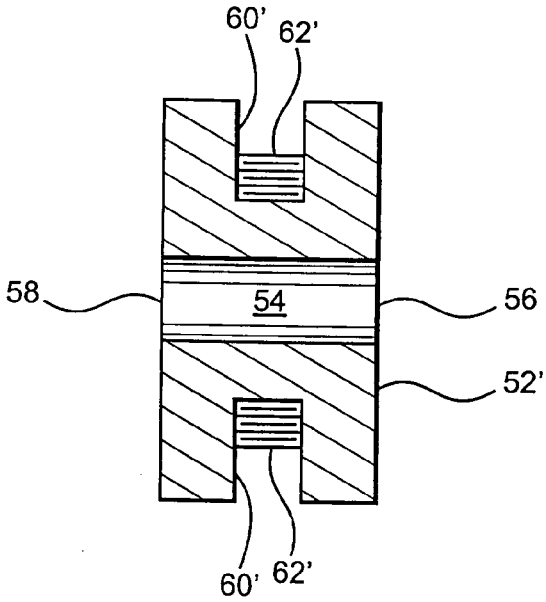
FIG. 11A is a sectional view of one of a plurality of locking members associated with another embodiment of the locking assembly of the present invention.

In yet another embodiment, the locking members 52' may comprise an open ended receiving channel 60' having an internally threaded surface 62' at either end, as illustrated in FIG. 11A. In this embodiment, one of the threaded ends 22' of each of a corresponding pair of mounting members 22 is threaded into the opposite ends of the locking member 52'. In this embodiment, the locking members 52' function as an interface allowing two or more shutter assemblies to be interconnected to each another, via the locking members 52', as may be required to cover and protect a large or irregular shaped opening in the building or other structure being protected. Of course, it is understood that in this embodiment, the base member 14 or 16 will comprise inlet openings 28' through both the innermost and outermost longitudinal sidewalls, 30' and 30", respectively, to permit the passage of the threaded ends 22' of each of the corresponding pair of mounting members 22 therethrough and into the opposite ends of the locking members 52'.

When the locking members 52 are removably mounted within the interior 19' of the base segments 14 and 16, it should be apparent that the interior of each receiving channel 60 associated with the locking members 52 of both of the base segments 14 and 16 may be threaded. As such, the locking members 52 are first threaded onto both opposite ends 22' of each of the mounting members 22 and subsequently passed into the interior 19' of the respective base segments 14 and 16. The base segments 14 and 16 are then anchored to the building or other structure in the manner set forth above.

However, when the locking members 52 are fixedly or permanently secured on the interior 19' of the base segments 14 and 16 at least one set of locking members 52, associated with either the base segments 14 or the base segments 16, should be absent the threaded interior 62 so as to slidingly and freely receive a corresponding one of the opposite ends 22' of the mounting members 22 therein. Therefore, each of the mounting members 22 may be threaded to the locking members 52 within one of the base segments 14 and 16 and will be freely and slidingly received within the locking members 52 of the other of the base segments 14 and 16.

Therefore, each of the preferred embodiments of the shutter assembly 10 or 10' of the present invention may be removably or fixedly mounted on the exterior portion of a building or other structure. Moreover, each of the plurality of slats 18 may assume any one of a variety of predetermined arrays defining either a closed configuration as shown in FIG. 1 or in at least partially open configuration as shown in FIG. 2.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A shutter assembly comprising:

a) a frame assembly securable to a supporting structure and including at least one base segment, b) said frame assembly further including a mounting assembly connected to said base segment and extending between opposite ends of said frame assembly, c) a plurality of slats connected to said mounting assembly and collectively disposed in at least one predetermined array along a length of said frame assembly in overlying relation to the supporting structure, d) each of said plurality of slats comprises a passageway extending therethrough, said mounting assembly disposed and dimensioned to extend through at least a portion of said passageway in each of said plurality of slats, e) said mounting assembly comprising a plurality of mounting members disposed in spaced relation to one another, and f) said passageway of each of said plurality of slats comprising a plurality of passages disposed along a length of said slat and receiving one of said mounting members in each of said passages.

2. A shutter assembly as recited in claim 1 wherein said frame assembly comprises a first base segment and a second base segment each disposed to define opposite peripheral portions of said frame assembly, said mounting assembly extending transverse to said first and second base segments and having opposite ends thereof connected to corresponding ones of said first and second base segments.

3. A shutter assembly as recited in claim 2 wherein said mounting assembly is formed of a substantially rigid, high strength material.

4. A shutter assembly as recited in claim 2 wherein said plurality of slats are connected to said mounting assembly in substantially parallel relation to said first and second base segments.

5. A shutter assembly as recited in claim 2 wherein opposite ends of each of said plurality of mounting members are connected to correspondingly positioned ones of said first and second base segments.

6. A shutter assembly as recited in claim 5 wherein said plurality of slats are connected in transverse relation to said plurality of mounting members and oriented in substantially parallel relation to one another and to said first and second base segments.

7. A shutter assembly as recited in claim 5 wherein said one predetermined array comprises at least some adjacent ones of said plurality of slats disposed in spaced relation to one another.

8. A shutter assembly as recited in claim 5 wherein said one predetermined array comprises adjacent ones of said plurality of slats disposed in spaced relation to one another.

9. A shutter assembly as recited in claim 5 wherein said one predetermined array comprises adjacent ones of said plurality of slats disposed in confronting relation to one another along a length of said mounting members.

10. A shutter assembly as recited in claim 1 wherein said plurality of slats are disposed in substantially parallel relation to one another and in substantially transverse relation to said plurality of mounting members.

11. A shutter assembly as recited in claim 10 wherein said plurality of slats and said plurality of mounting members are cooperatively structured for removable interconnection to assume any one of a plurality of predetermined arrays.

12. A shutter assembly as recited in claim 11 wherein one of said plurality of predetermined arrays comprises adjacent ones of said plurality of slats disposed in confronting relation to one another along the length of said plurality of mounting members.

13. A shutter assembly as recited in claim 11 wherein one of said plurality of predetermined arrays comprises adjacent ones of said plurality of slats disposed in spaced relation to one another.

14. A shutter assembly as recited in claim 13 further comprising a spacer assembly connected to said mounting assembly and disposed between spaced apart ones of said plurality of slats.

15. A shutter assembly comprising:

a) a frame assembly securable to a supporting structure and including a plurality of base segments, b) said frame assembly further including a mounting assembly connected to said base segments and extending between opposite ends of said frame assembly, c) at least two of said base segments disposed in spaced relation to one another and connected to said mounting assembly, d) said two base segments disposed to define opposite peripheral portions of said frame assembly, e) said mounting assembly extending along a length of said frame assembly between and connected to said base segments, f) said mounting assembly comprising a plurality of mounting members disposed in spaced relation to one another, g) a plurality of slats connected to said mounting assembly and collectively disposed in at least one predetermined array along a length of said frame assembly in overlying relation to the supporting structure, h) each of said plurality of slats comprising a passageway extending therethrough, said mounting assembly disposed and dimensioned to extend through at least a portion of said passageway in each of said plurality of slats, and i) each of said plurality of mounting members is connected to said plurality of slats.

16. A shutter assembly as recited in claim 15 wherein each of said plurality of mounting members is formed from a substantially rigid, high strength material.

17. A shutter assembly as recited in claim 16 wherein said substantially rigid, high strength material is an aluminum alloy.

18. A shutter assembly comprising:

a) a first base segment and a second base segment disposed in spaced relation to one another, b) a mounting assembly including a plurality of elongated mounting members connected to and extending between said first and second base segments, c) a plurality of slats removably connected to said plurality of mounting members and disposed in at least one of a plurality of predetermined arrays along a length of said mounting members, d) said at least one predetermined array comprising at least some of adjacent ones of said plurality of slats disposed in spaced relation to one another, and e) a spacer assembly connected to said mounting assembly and disposed between spaced apart ones of said plurality of slats.

19. A shutter assembly as recited in claim 18 wherein said spacer assembly comprises a plurality of spacer members mounted on at least some of said plurality of mounting members between adjacent spaced apart part ones of said plurality of slats.

20. A shutter assembly comprising:

a) a first base segment and a second base segment disposed in spaced relation to one another, b) a mounting assembly including a plurality of elongated mounting members connected to and extending between said first and second base segments, c) a plurality of slats removably connected to said plurality of mounting members and disposed in at least one predetermined array along a length of said mounting members, and d) a locking assembly structured to secure said plurality of mounting members to at least one of said base segments.

21. A shutter assembly as recited in claim 20 wherein said locking assembly comprises a plurality of locking members secured to opposite ends of at least some of said plurality of mounting members.

22. A shutter assembly as recited in claim 21 wherein at least some of said locking members are threadedly attached to a correspondingly positioned end of said mounting members.

23. A shutter assembly as recited in claim 20 wherein said locking assembly is fixedly connected to at least one of said first or second base segments in receiving relation to correspondingly positioned ends of said plurality of mounting members.

24. A shutter assembly as recited in claim 20 wherein said locking assembly is disposed and structured to interconnect at least one of said base segments to a supporting structure.

25. A shutter assembly comprising:

a) a frame assembly attachable to a supporting structure and comprising spaced apart peripheral base segments, b) said frame assembly further comprising a plurality of mounting members extending between and connected to oppositely disposed ones of said base segments, c) a plurality of slats each including a passageway formed therein, each said passageway comprising a plurality of passages disposed along a length of said slat and receiving one of said mounting members in each of said passages, d) said plurality of slats removably mounted on said frame assembly in protective relation to the supporting structure and in at least one predetermined array, e) said plurality of slats and said plurality of mounting members are formed of a substantially rigid, high strength material, and f) said substantially rigid, high strength material is an aluminum alloy.

26. A shutter assembly as recited in claim 25 wherein said one predetermined array comprises at least some of adjacent ones of said plurality of slats disposed in spaced relation to one another.

27. A shutter assembly as recited in claim 26 further comprising a spacer assembly connected to a mounting assembly and disposed between spaced apart ones of said plurality of slats.

28. A shutter assembly as recited in claim 25 further comprising a locking assembly structured to secure said plurality of mounting members to at least one of said base segments.

29. A shutter assembly as recited in claim 28 wherein said locking assembly is disposed and structured to interconnect at least one of said base segments to the supporting structure.

30. A shutter assembly as recited in claim 28 wherein said locking assembly is fixedly connected to at least one of said base segments in receiving relation to corresponding ends of said plurality of mounting members.

31. A shutter assembly as recited in claim 25 wherein each of said plurality of slats comprises a hollow interior portion extending along at least a majority of a length thereof.

32. A shutter assembly comprising:

a) a frame assembly including a locking assembly, b) said locking assembly comprising a plurality of locking members each structured and disposed to be attachable to a supporting structure, c) said frame assembly further comprising a plurality of mounting members extending between and connected to oppositely disposed corresponding ones of said locking members, d) a plurality of slats each including a passageway formed therein for passage of said plurality of mounting members therethrough, e) said plurality of slats removably mounted on said frame assembly in protective relation to the supporting structure and in at least one predetermined array, and f) said plurality of locking members further structured to removably secure said plurality of slats to said frame assembly in said protective relation.

33. A shutter assembly comprising:

a) a frame assembly attachable to a supporting structure and comprising spaced apart peripheral base segments, b) said frame assembly further comprising a plurality of mounting members extending between and connected to oppositely disposed ones of said base segments, c) a plurality of slats each including a passageway formed therein for passage of said plurality of mounting members therethrough, d) said plurality of slats removably mounted on said frame assembly in protective relation to the supporting structure and in at least one predetermined array, e) said one predetermined array comprises at least some of adjacent ones of said plurality of slats disposed in spaced relation to one another, and f) a spacer assembly connected to a mounting assembly and disposed between spaced apart ones of said plurality of slats.

34. A shutter assembly comprising:

a) a frame assembly attachable to a supporting structure and comprising spaced apart peripheral base segments, b) said frame assembly further comprising a plurality of mounting members extending between and connected to oppositely disposed ones of said base segments, c) a plurality of slats each including a passageway formed therein for passage of said plurality of mounting members therethrough, d) said plurality of slats removably mounted on said frame assembly in protective relation to the supporting structure and in at least one predetermined array, and e) a locking assembly structured to secure said plurality of mounting members to at least one of said base segments.

35. A shutter assembly as recited in claim 34 wherein said locking assembly is disposed and structured to interconnect at least one of said base segments to the supporting structure.

36. A shutter assembly as recited in claim 34 wherein said locking assembly is fixedly connected to at least one of said base segments in receiving relation to corresponding ends of said plurality of mounting members.

* * * * *

UNITED STATES PATENT AND TRADEMARK OFFICE

CERTIFICATE OF CORRECTION

PATENT NO. : 6,968,660 B1
DATED : November 29, 2005
INVENTOR(S) : Pablo Raba Novoa It is certified that error appears in the above-identified patent and that said Letters Patent is hereby corrected as shown below:

Title page,
Item [56], References Cited, U.S. PATENT DOCUMENTS,
"3,286,242A 11/1966 Weyant" should read:
-- 3,286,424A 11/1966 Weyant --.

Signed and Sealed this

Fourteenth Day of February, 2006

JON W. DUDAS
*Director of the United States Patent and Trademark Office*